United States Patent [19]

Nicoloso et al.

[11] Patent Number: 4,467,157

[45] Date of Patent: Aug. 21, 1984

[54] PRESSURIZED GAS CIRCUIT BREAKER INCLUDING TWO V-MOUNTED BREAKER CHAMBERS PER PHASE

[75] Inventors: Dante Nicoloso; Doan Pham Van, both of Meyzieu, France

[73] Assignee: Alsthom-Atlantique, Paris, France

[21] Appl. No.: 433,493

[22] Filed: Oct. 8, 1982

[30] Foreign Application Priority Data

Oct. 12, 1981 [FR] France ..... 81 19157
May 17, 1982 [FR] France ..... 82 08548

[51] Int. Cl.[3] ..... H01H 33/42

[52] U.S. Cl. ..... 200/148 F; 200/148 R; 200/148 D; 200/148 B

[58] Field of Search ..... 200/148 F, 148 D, 148 R, 200/148 A, 148 B

[56] References Cited

U.S. PATENT DOCUMENTS 4,223,191 9/1980 Calvino ..... 200/148 A
4,365,126 12/1982 Oshima et al. ..... 200/148 F

FOREIGN PATENT DOCUMENTS 580699 7/1933 Fed. Rep. of Germany ... 200/148 D
1414370 9/1965 France ..... 200/148 F
432622 9/1967 Switzerland ..... 200/148 F
449098 4/1968 Switzerland ..... 200/148 D

*Primary Examiner*—Robert S. Macon
*Attorney, Agent, or Firm*—Sughrue, Mion, Zinn, Macpeak, and Seas

[57] ABSTRACT

A pressurized gas circuit breaker capable of having a breaker chamber dismantled therefrom without loss of dielectric gas comprises: a vertical insulating support (101); a intermediate structure (100) mounted on said support and at least two breaker chambers (1, 1') per phase. Said chambers are disposed in a V-configuration on said intermediate structure, and said support and said breaker chambers are filled with gas under pressure. The circuit breaker further comprises a control jack (32) situated at the bottom of the support, and means for transmitting motion from the jack to the chambers to operate circuit breaking means located therein. Said means for transmitting motion comprise: gas-tight guide tube means (2, 2') filled, in use, with gas under pressure and having a straight insulating portion (102) situated inside the vertical insulating support and curved portions (103) situated inside said intermediate structure and leading to respective ones of said breaker chambers. Control shaft means (42, 42') are mounted with a sliding fit inside said guide tube means, and have one end connected to said control jack, and other ends connected to respective ones of said breaker chambers. The portions (107) of said control shaft means that slide in the curved guide tube portions are flexible. Each breaker chamber is fitted with a respective sliding air-lock (see FIG. 2) capable at one end of sealing the breaker chamber and at another end of sealing the guide tube means. Said air-lock comprises two separable members one of which is made fast to the breaker chamber and the other of which is made fast to the guide tube means; and said control shaft means comprise coupling means located inside said air-lock to enable the control shaft means to be separated into a first portion connected to the breaker chamber and a second portion connected to the guide tube means.

7 Claims, 13 Drawing Figures

PRESSURIZED GAS CIRCUIT BREAKER INCLUDING TWO V-MOUNTED BREAKER CHAMBERS PER PHASE

The present invention relates to a pressurized gas circuit breaker including two V-mounted breaker chambers per phase, with the breaker chambers disposed on top of a vertical insulating support. The breaker chambers and the vertical support are filled with gas under pressure, and each breaker chamber is associated with means for transmitting motion from a control jack located at the foot of the insulator to contacts located in the breaker chamber.

BACKGROUND OF THE INVENTION

In known circuit breakers of this type, a vertical control shaft connected to the control jack is used to actuate two levers which serve to drive respective rods which are connected to the contacts in the breaker chambers. Since the chambers and the support contain a gas under pressure (e.g. $SF_6$), there are two varieties of circuit breaker:

In the first variety, the intermediate structure between the support and the breaker chambers is gas-tight and is filled with gas under pressure, in which case the gas circulates freely between the breaker chambers and the support. Under such circumstances it is not possible to dismantle any one component, e.g. one of the chambers, without completely emtying the entire circuit breaker of its gas, which then leads to problems during re-assembly since the entire circuit breaker must be dried and evacuated of air before $SF_6$ is re-inserted therein. Thorough drying is most important.

In the second variety, the intermediate structure is not under pressure, which means that gas-tight sliding joints are required around the control shaft where it passes from the vertical support to the intermediate structure, and around the two rods where they pass from the intermediate structure into the respective breaker chambers.

Such sliding seals are difficult to make, and they are not always reliable.

The present invention provides a circuit breaker which includes an intermediate structure that is not filled with gas under pressure, and which is thus accessible thereby making it possible to disconnect gas communication between the various parts of the circuit breaker, thus enabling a single part (e.g. a breaker chamber) to be removed on its own.

SUMMARY OF THE INVENTION

The present invention provides a pressurized gas circuit breaker comprising: a vertical insulating support; an intermediate structure mounted on said support and at least two breaker chambers per phase, said chambers being disposed in a V-configuration on said intermediate structure, said support and said breaker chambers being filled with gas under pressure; said circuit breaker further comprising a control jack situtated at the bottom of the support, and means for transmitting motion from the jack to the chambers to operate circuit breaking means located therein; wherein said means for transmitting motion comprise: gas-tight guide tube means filled, in use, with gas under pressure and having a straight insulating portion situated inside the vertical insulating support and curved portions situated inside said intermediate structure and leading to respective ones of said breaker chambers; and control shaft means mounted with a sliding fit inside said guide tube means, said control shaft means having one end connected to said control jack, and other ends connected to respective ones of said breaker chambers, the portions of said control shaft means that slide in the curved guide tube portions being flexible; and wherein each breaker chamber is fitted with a respective sliding air-lock capable at one end of sealing the breaker chamber and at another end of sealing the guide tube means, said air-lock comprising two separable members one of which is made fast to the breaker chamber and the other of which is made fast to the guide tube means, and said control shaft means comprising coupling means located inside said air-lock to enable the control shaft means to be separated into a first portion connectd to the breaker chamber and a second portion connected to the guide tube means.

When the circuit breaker is disassembled, the air-locks ensure that the pressurized gas inside the breaker chambers and inside the guide tube means remains unadulterated. This means there is no need to create a vacuum before re-filling the members with gas on re-assembly of the circuit breaker. The air-locks are known per se and are described in the present Assignee's German published patent specification No. 3 044 366.

In a preferred embodiment of the invention, the portions of the control shaft means that slide in the curved portions of the guide tube means comprises a rod of smaller diameter than the guide tube means. Said rod is provided with a sequence of regularly spaced guide rings which engage both the rod and the inside of the guide tube means, but which allow the pressurised gas to flow freely along the guide tube means.

In another embodiment, the flexible portions of the control shaft means are likewise of smaller diameter than the rest of the control shaft means, but they are a sliding fit inside curved guide tube means, thereby preventing free flow of gas along the guide tube means. In this case the gas flows via tubing which by-passes curved portions of the guide tube means. Said tubing is provided with stop cocks enabling it to be dismantled without loosing gas.

A third variety of flexible control shaft comprises a roller chain disposed in a curved length of guide tube means that is of rectangular or square cross section. A roller chain makes it possible to increase the angle of the V-configuration, in some cases all the way to 180°.

BRIEF DESCRIPTION OF THE DRAWINGS

Embodiments of the invention are described by way of example with reference to the accompanying drawings, in which.

MORE DETAILED DESCRIPTION

Figure 1A:
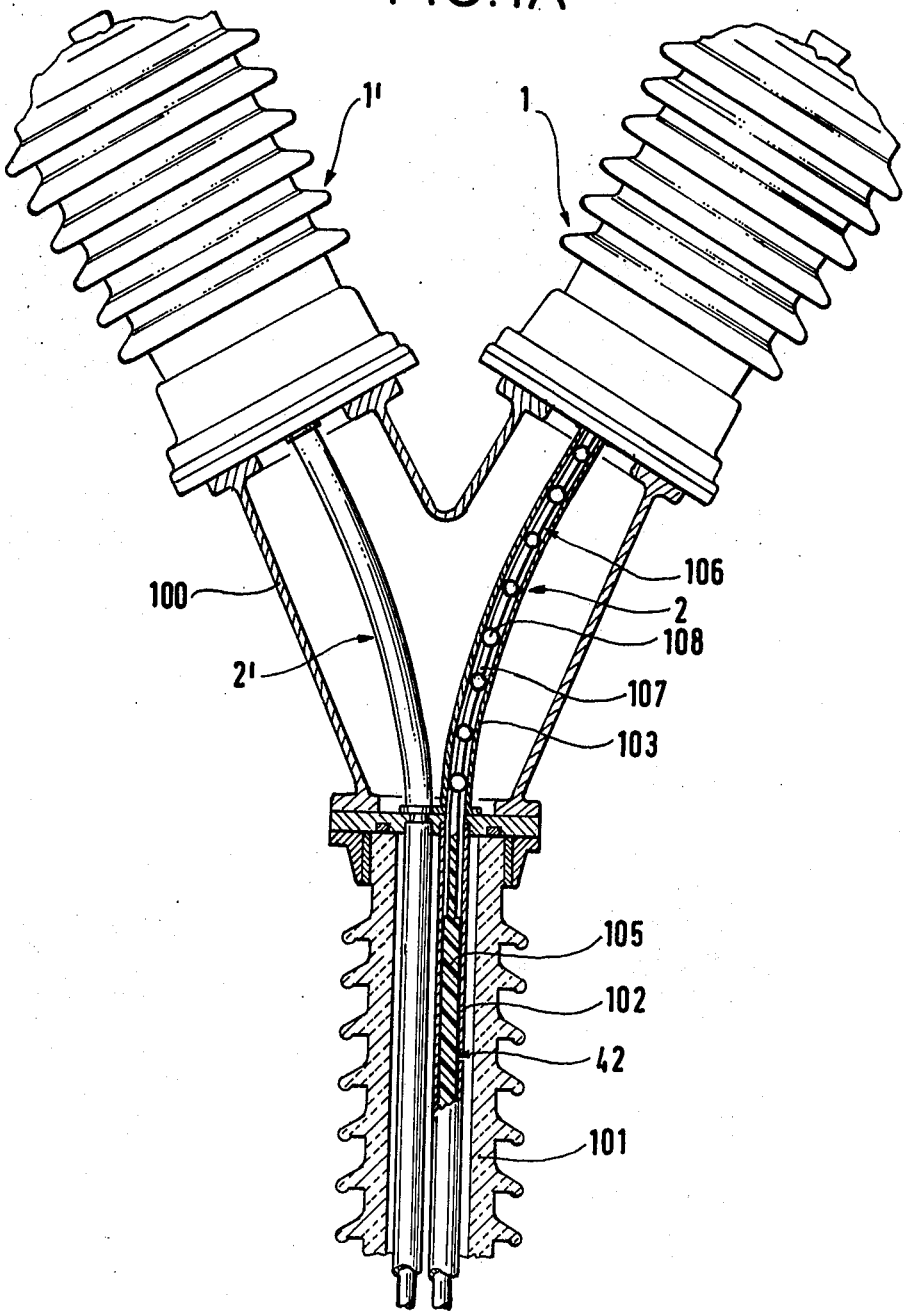
FIGS. 1A and 1B are diagrammatic views, partially in section, of the top and the bottom respectively of a circuit breaker in accordance with the invention.
Figure 1B:
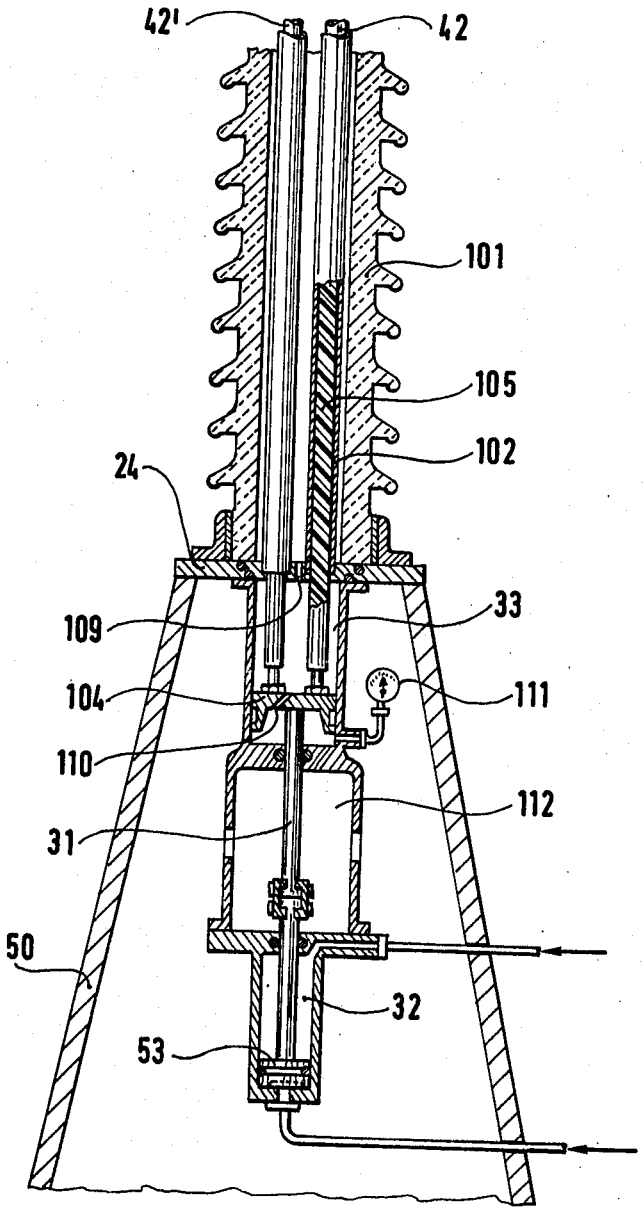

Reference is made initially to FIGS. 1A and 1B which show the equipment for one phase of an $SF_6$ circuit breaker in accordance with the invention.

This equipment comprises two electrically connected breaker chambers 1 and 1' including respective cylindrical ceramic insulators mounted in a V-formation on a Y-shaped intermediate structure 100. The structure 100 is mounted on a supporting cylindrical insulator 101, itself mounted on a metal frame 50. The structure 100 has openings giving access to its internal components. Electrical connection between the chambers 1 and 1' is provided by the intermedate structure 100 itself or else by a connection inside the structure 100.

The two circuit breaker chambers 1 and 1' are substantially idential, and to simplify the description, most of the following description relates in particular to the chamber 1 and its associated parts. Where it is necessary to distinguish between the chambers, like parts are given the same reference numerals, but with the addition of a prime.

Each breaker chamber houses fixed contact fingers connected to an external connection terminal (not shown). The fixed contact fingers co-operate in conventional manner with a moving contact formed on the end of a rod 6 (see FIG. 2) and lying along the axis of the breaker chamber.

The rod 6 is connected to the top of a control shaft 42.

Each rod 6 is conductive, and is connected via a sliding connection 54 and a cylindrical chamber 23 to an annular plate having an external connection terminal mounted thereon (not shown). The control shaft 42 slides freely in a guide tube 2 which prevents the shaft 42 from buckling. The guide tube 2 includes an insulating portion 102 situated inside the support 101, and a curved portion 103 which is located in the structure 100 with one end being connected to the chamber 1.

The bottom ends of both of the control shafts 42 and 42' are connected to a beam 104 located in an intermediate chamber 3 underneath the support 101, between the support and a control jack 32. The beam 104 acts like a guide piston in the chamber 33 and is connected by a rod 31 to the piston 53 of the jack 32. The jack 32 is used to move the control shafts 42 and 42'.

The guide tubes 2 and 2' run from the base of the support 102 all the way up to the chambers 1 and 1', and pass through a sealed, but static, joint at the top of the support 101.

The control shaft 42 has a portion 105 which is preferably of cruciform cross section (as described in French patent application No. 79 18339). This portion 105 is located in the vertical part 102 of the guide tube 2. The shaft 42 further has a flexible portion 106 for sliding in the curved portion 103 of the guide tube 2. The flexible portion 106 comprises a rod 107 of smaller cross section than the tube 2, and is provided with equidistant rings 108 that are not gas-tight. Advantageously, the rod 107 is made of metal while the rings are made of plastics material or of a metal, such as brass, suitable for avoiding binding.

The inside volumes of the chamber 33, the support 101, the guide tubes 2 and 2', and the breaker chambers 1 and 14 are all filled with $SF_6$ under pressure.

The only sliding seal is a seal around the piston rod 31 at the bottom of the chamber 33. To improve gas flow, orifices such as 109 are provided through the base of the support 101 providing communication between the inside of the support and the chamber 33, thereby slowing the rod as little as possible in operation. Similarly, the beam 104 has an orifice 110 passing through it. The cross-shaped section of the vertical portions of the control shafts enable $SF_6$ gas to fill the guide tubes 2 and 2' from the chamber 33 when the system is being filled with gas, whence the gas flows along the flexible portions of the shafts to reach the breaker chambers 1 and 1'.

Means 111 for measuring the pressure of the gas are provided at the bottom of the chamber 33.

On its path between the chamber 33 and the jack 32, the piston rod 31 passes through a chamber 112 filled with ambient air.

To close the circuit breaker, fluid such as oil under pressure is applied to the bottom face of the piston 53, thereby pushing up the piston rod 31, the beam 104, and thence the control shafts 42 and 42'. The control shafts are a sliding fit in the tubes 2 and 2' and serve to convey the piston motion to the moving contacts of the chambers 1 and 1'.

To open the circuit breaker, the motion is reversed by applying fluid under pressure to the top face of the piston 53.

Figure 2:
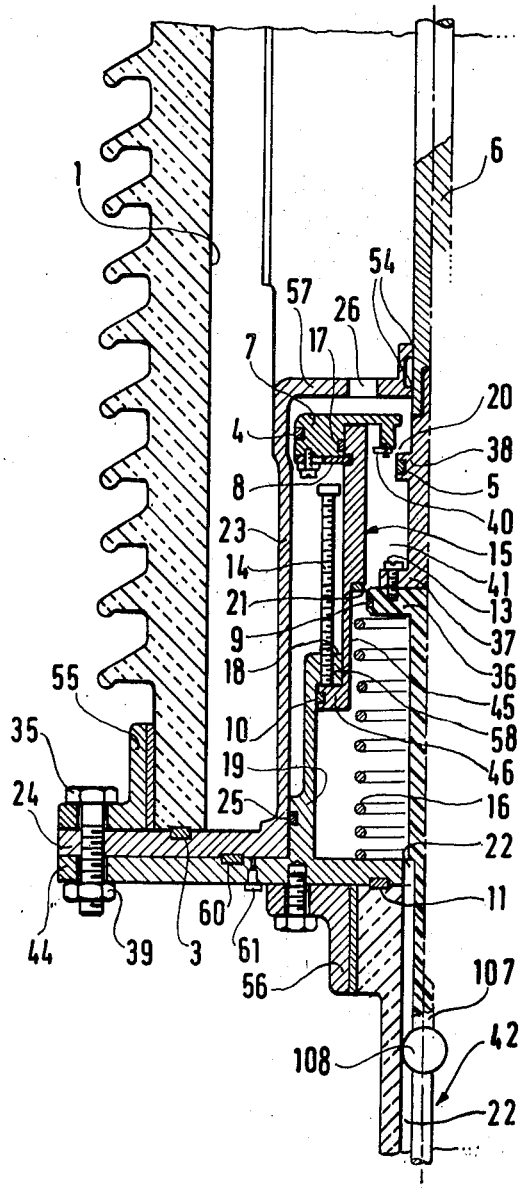
FIG. 2 is diagrammatic half section showing in detail the assembly of a guide tube and a breaker chamber in the closed position.

FIG. 2 shows assembly of the breaker chamber 1 to the tube 2 in greater detail. The bottom end of the breaker chamber 1 has a fixing flange 55 which is screwed to the abovementioned annular plate 24. The top end of the insulating support 2 also has a fixing flange 56, and it is screwed a second annular plate 44. Tha assembly constituted by flange 55 and the plate 24 is assembled to the second plate 44 by screws 35 and nuts 39. The breaker chamber 1 is sealed to the plate 24 by means of a sealing ring 3, while the tube 2 is sealed to the second plate 44 by means of a sealing ring 11.

The first annular plate 24 has a cylinder 23 projecting from its inside rim into the breaker chamber 1. The end 57 of the cylinder 23 is annular and surrounds the rod 6 with which it maintains sliding contact via a contact 54. There are holes 26 through the annular end 57 of the cylinder 23.

The inside periphery of the second annular plate 44 is disposed around a passage 22 which surrounds the insulating portion 42 of the control shaft. The plate 44 also has a cylinder 19 projecting into the breaker chamber 1. The base of the cylinder 19 is surrounded by a sealing ring 25 which co-operates with the inside surface of the cylinder 23 inside which the cylinder 19 is threaded. The end of the cylinder 19 has an inwardly directed flange 18 having a plurality of tapped holes 58 passing therethrough parallel to the shaft 42.

A hollow piston with an overall reference number 15 is disposed around the end portions of the rod 6 and the insulating portion 42 of the control shaft 42, and extends from the end of the cylinder 19 up nearly as far as the end of the cylinder 23.

The piston 15 comprises a cylindrical body 45 having both bottom flange 46 which is engaged under the inwardly-directed flange 18 of the cylinder 19 (together with a sealing ring 10 which co-operates with the inside surface of the cylinder 19), and an annular head 7 which overhangs the cylindrical body 45 both inwardly and outwardly. The outside of the head 7 is provided with a sealing ring 4 suitable for co-operating with the inside wall of the cylindrical sleeve 23, and a sealing ring 17 is interposed between the outside wall of the cylindrical body 45 and the head 7. Retractable retaining lugs 8 are disposed underneath the outside portion of the head 7 and similarly retractable retaining lugs 40 are disposed underneath the inside portion of the head 7. A compression spring 16 is interposed between the body 45 and the second annular plate 44, with the spring engaging an undercut portion of the body 45. Operating screws 14 are screwed into the tapped holes 58 with their heads disposed adjacent the retractable retaining lugs 8.

The top of the control shaft 42 has a circular flange 36 having a sealing ring 9 in its outside surface for co-operating with the inside wall of the cylindrical body 45.

The bottom of the rod 6 has a matching flange 37 which is screwed by screws 13 to the flange 36. The rod 6 further includes an outwardly projecting girth ring 38 located above the flange 37 and provided with a peripheral sealing ring 5 suitable for co-operating with the inside wall of the piston head 7.

FIG. 2 shows the circuit breaker in the closed position, with the control shaft 42 thrust into a high position by the control jack 32. In this position there is a variable air-lock volume 41 located in between the rod 6 together with the cylindrical piston body 45 and the flange 36 together with the inside wall of the piston head 7. At one end of the air-lock volume 41 there is an annular passage 21 between the edge of the flange 36 and the cylindrical body 45. At the other end of the air-lock volume 41 there is an annular passage 20 between the girth ring 38 and the inside wall of the piston head 7.

The closed volumes delimited by the breaker chamber 1 and the tube 2 are gas-tight and filled with a dielectric gas under pressure. However, there is free communication between said closed volumes via the orifices 26, the passage 20, the air-lock 41, the passage 21 and the passage 22 between the control shaft 42, the plate 44, and the tube 2.

When the breaker is in the open position, the operating rod 42 is lowered by the control jack 32, and the annular passages 20 and 21 open the air-lock 41 wider and the said closed volumes remain in communication.

Figure 3:
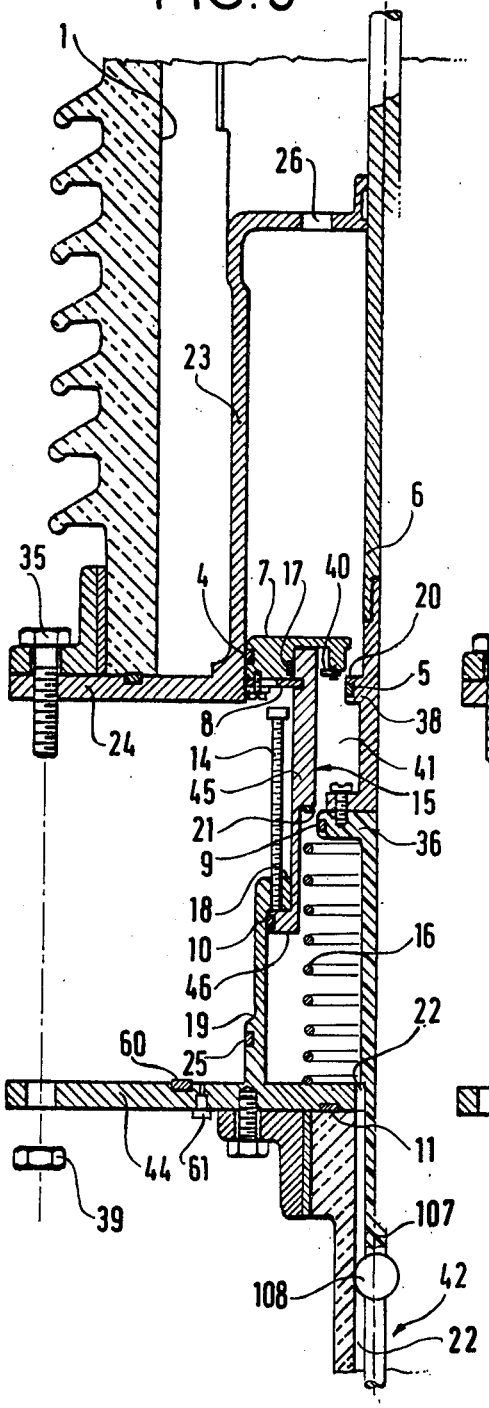
FIG. 3 is a view similar to FIG. 2, showing a first disassembly step.
Figure 4:
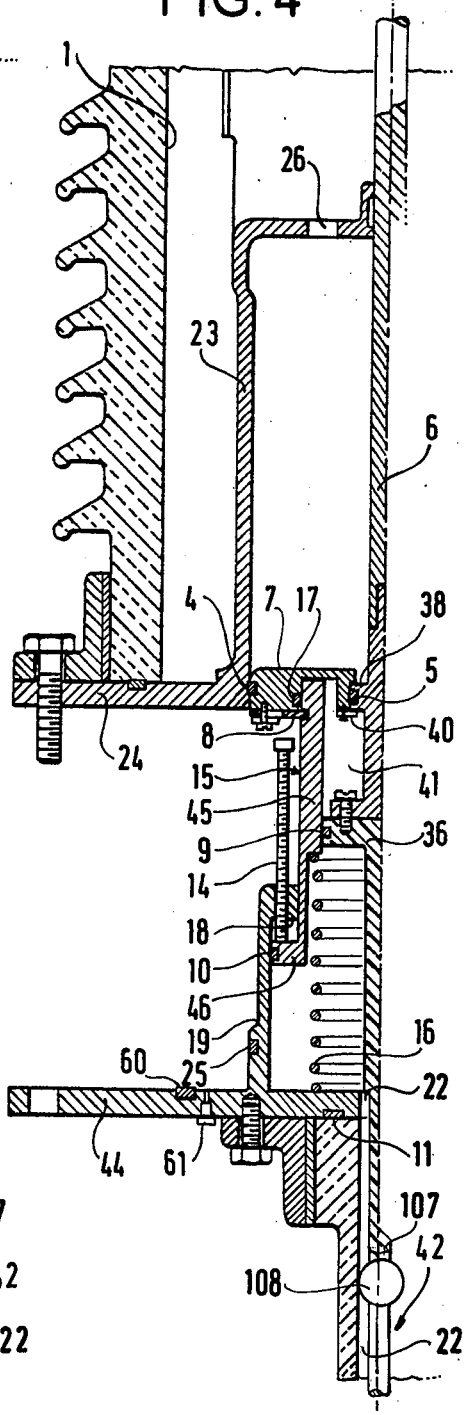
FIG. 4 is a view similar to FIG. 3, showing a second disassembly step.

The breaker chamber is disassembled and separated from the tube 2 as follows, starting from the closed position of the breaker chamber. During a first step, which ends in the position shown in FIG. 3, the chamber and the tube are loosened by undoing the nuts 39 from the screws 35, and then lifting means (not shown) are used to lift the plate 24 and the breaker chamber away from the plate 44. While this is going on, the cylinder 23 slides initially over the cylinder 19 and then over the piston head 7. The breaker chamber 1 is kept gas-tight initially by the sealing ring 25 and then by the sealing rings 25 and 4 acting simultaneously before the sealing ring 25 looses contact with the cylinder 23. After this manoeuver, the heads of the screws 14 are accessible, thereby enabling the screws 14 to be screwed down. The flange 46 at the bottom of the piston is thus moved downwards away from its initial position in contact with the flange 18. The outside of the of the head continues to slide over the wall of the cylinder 23, but the inside wall of the head 7 closes the passage 20 until it fully engages the girth ring 38, while the flange 36 comes into engagement with the inside of the cylinder 45, as shown in FIG. 4.

Figure 5:
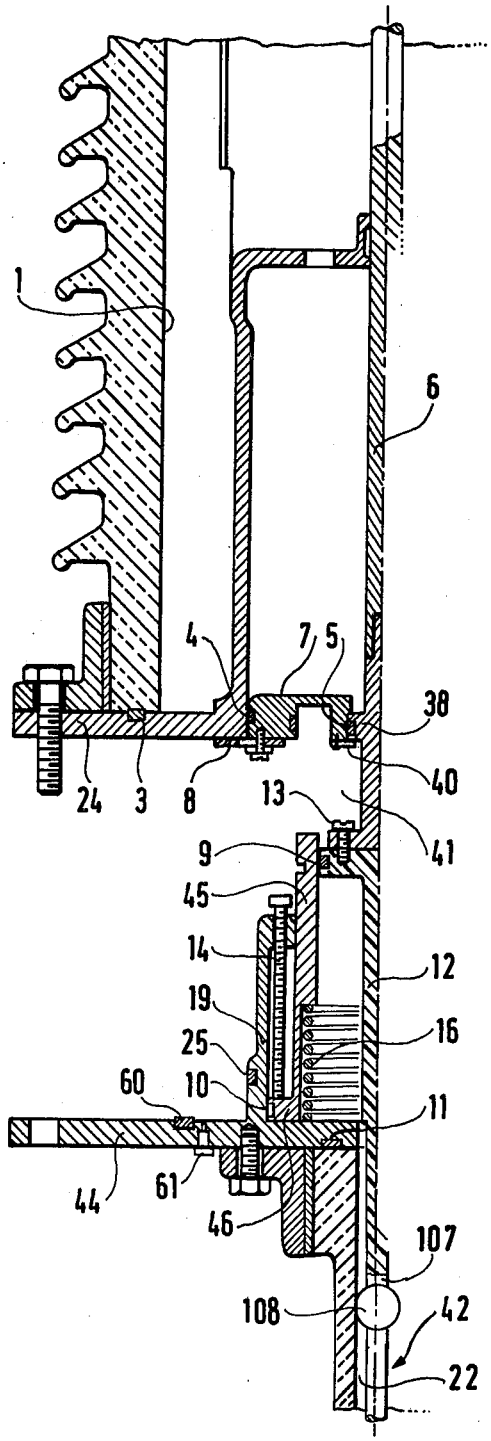
FIG. 5 is a view similar to FIG. 4, showing a third disassembly step.

In this position, the air-lock 41 has moved in such away that the annular passages 20 and 21 have disappeared, and there remains no communication between the air-lock and either the breaker chamber 1 or the tube 2. The sealing rings 9 and 5 then ensure gas-tightness. In this position the piston head 7 is made fast to the rod 6 by moving the retaining lug 40 under the girth ring 38. The piston head 7 is then released from the cylindrical body 45 by moving the retaining lug 8, and continuing the same operation makes the head fast to the plate 24 as shown in FIG. 5.

Once in this position, the screws 14 are screwed home, compressing the spring 16, until the bottom flange 46 of the cylindrical body 45 abuts against the plate 44.

The air-lock 41 is now open, giving access to the screws 13 which assemble the control shaft 42 to the rod 6. Once the screws 13 have been removed, the breaker chamber 1 can be completely separated from the insulator 2 without either closed volume ceasing to be gas-tight.

The only gas lost during disassembly comes from the air-lock 41 and from the volume that was enclosed between the cylinder 23 and the hollow piston 15 and the cylinder 19.

The reverse sequence of operations is used to assemble the breaker chamber 1 on the insulating support 2. The volume of air trapped between the sealing rings 25 and 60 as the plates 24 and 44 come together is allowed to escape via a bleeder 61.

If the apparatus is dismantled in a humid atmosphere, traces of dampness may be absorbed by the outside faces of the cylinders 19 and 23.

This dampness will be inside the apparatus after reassembly, and can lead to poor electrical insulation.

Thus, several varieties of the apparatus have been devised to mitigate this drawback.

Figure 6:
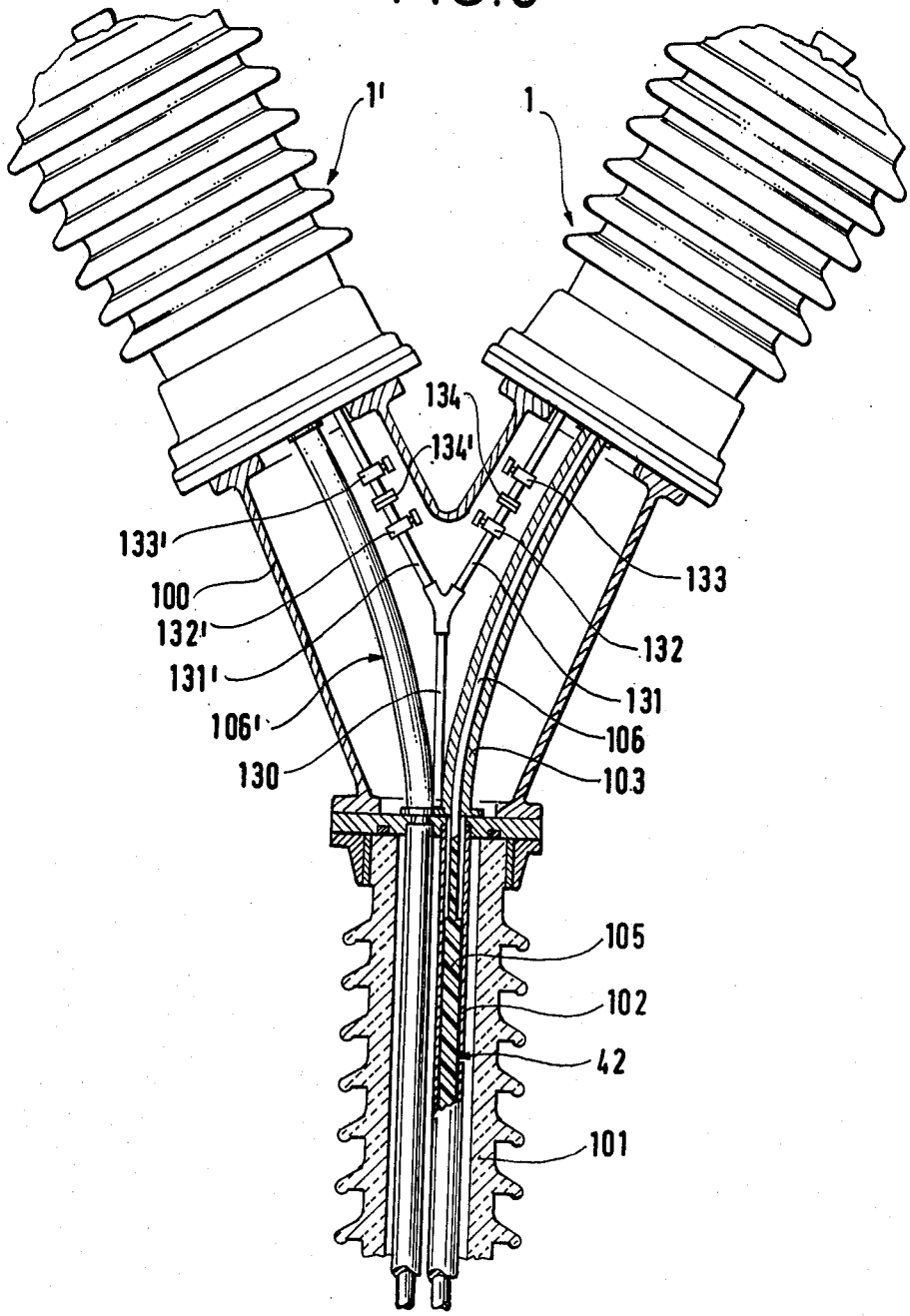
FIG. 6 is a view similar to FIG. 1A showing a second embodiment of the invention.

FIG. 6 shows one such variety. In this embodiment, the rings 108 inside the curved portion 103 of the guide tube 2 have been removed, and said curved portion is of smaller internal cross section than the straight portion 102 of the guide tube. The inside section of the curved portion 103 is substantially equal to the outside section of the flexible portion of rod 106 contained therein, thereby preventing gas from flowing along the curved portion.

A pipe 130 forks into two branches 131 and 131' and serves to interconnect the inside volume of the vertical support 101 to both of the chambers 1 and 1'. The gas $SF_6$ can thus flow between the support 101 and the chambers 1 and 1'.

The branch 131 is fitted with two cocks 132 and 133. These cocks serve to close the pipe. In between the two cocks 132 and 133 there is a coupling 134 enabling the pipework to be dismantled, while leaving both halves closed by the respective cocks. The other branch 131' is of identical structure, and like parts have the same reference numerals, but with a prime.

Figure 7:
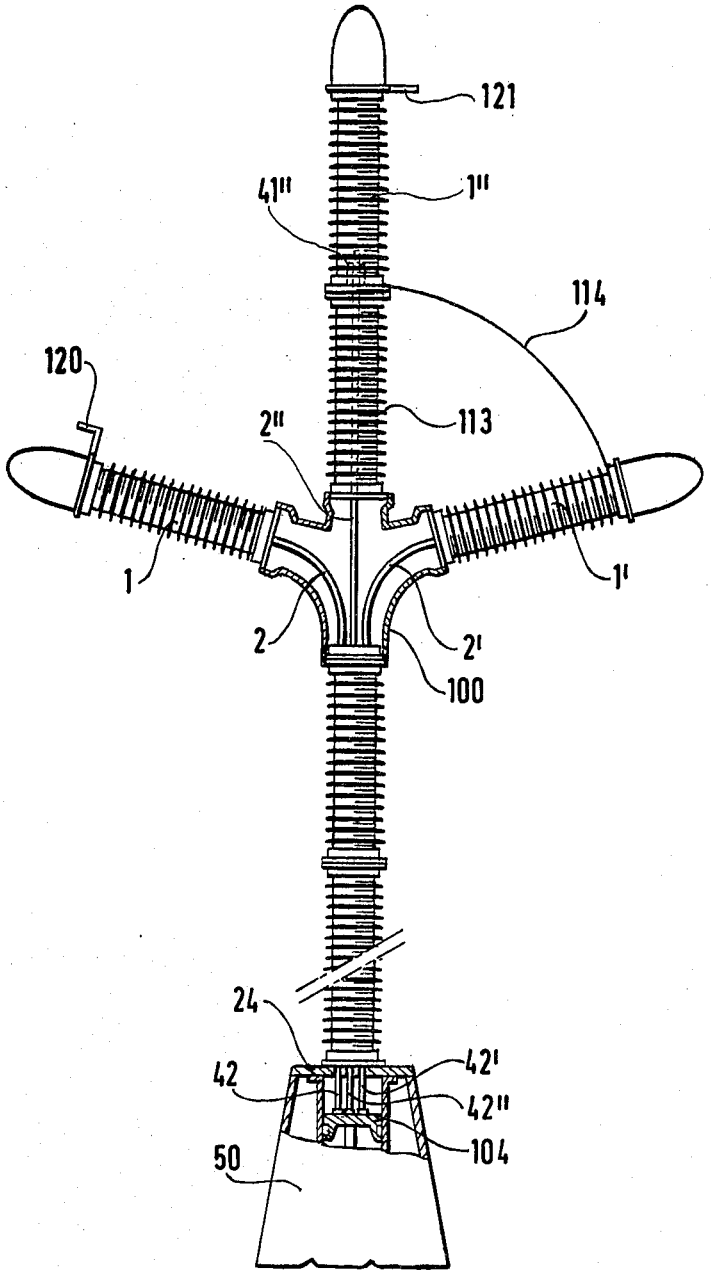
FIGS. 7 and 8 are partially cut-away side views showing embodiments of the invention having three breaker chambers per phase.

FIG. 7 shows a three chamber circuit breaker having its chambers connected electrically in series. Two of the chambers 1 and 1' are symmetrically disposed in a V-configuration on either side of a third chamber 1'' which is vertical.

The chamber 1'' is mounted on a vertical insulator 113 fixed on the intermediate structure 100.

The circuit breaker has a current inlet 120 on the chamber 1, a current outlet 121 on the third chamber 1'', and an electrical connection from the second chamber 1' to the third chamber 1'' via a line 114. The connection between the first and second chambers 1 and 1' is via the structure 100.

Since the third chamber 1'' is vertically above the control jack, its contacts are controlled by a vertical control shaft 42'' disposed in a vertical tube 2'' of constant cross section.

The vertical control shaft 42'' is preferably of cruciform or star-shaped cross section as described in French patent application No. 79 18339 in order to allow dielectric gas to flow along the tube 2''.

The control shaft 42'' has one end fixed to the beam 104, and the tube 2'' runs from the bottom 24 of the insulator 101 up as far as the breaker chamber 1'', with connection being made between the chamber 1'' and the tube 2'' via an air-lock arrangement (not shown in detail) 41'' which is substantially identical to that described with reference to FIGS. 2 to 6.

In the example shown, the angle of the V is about 155°.

Figure 8:
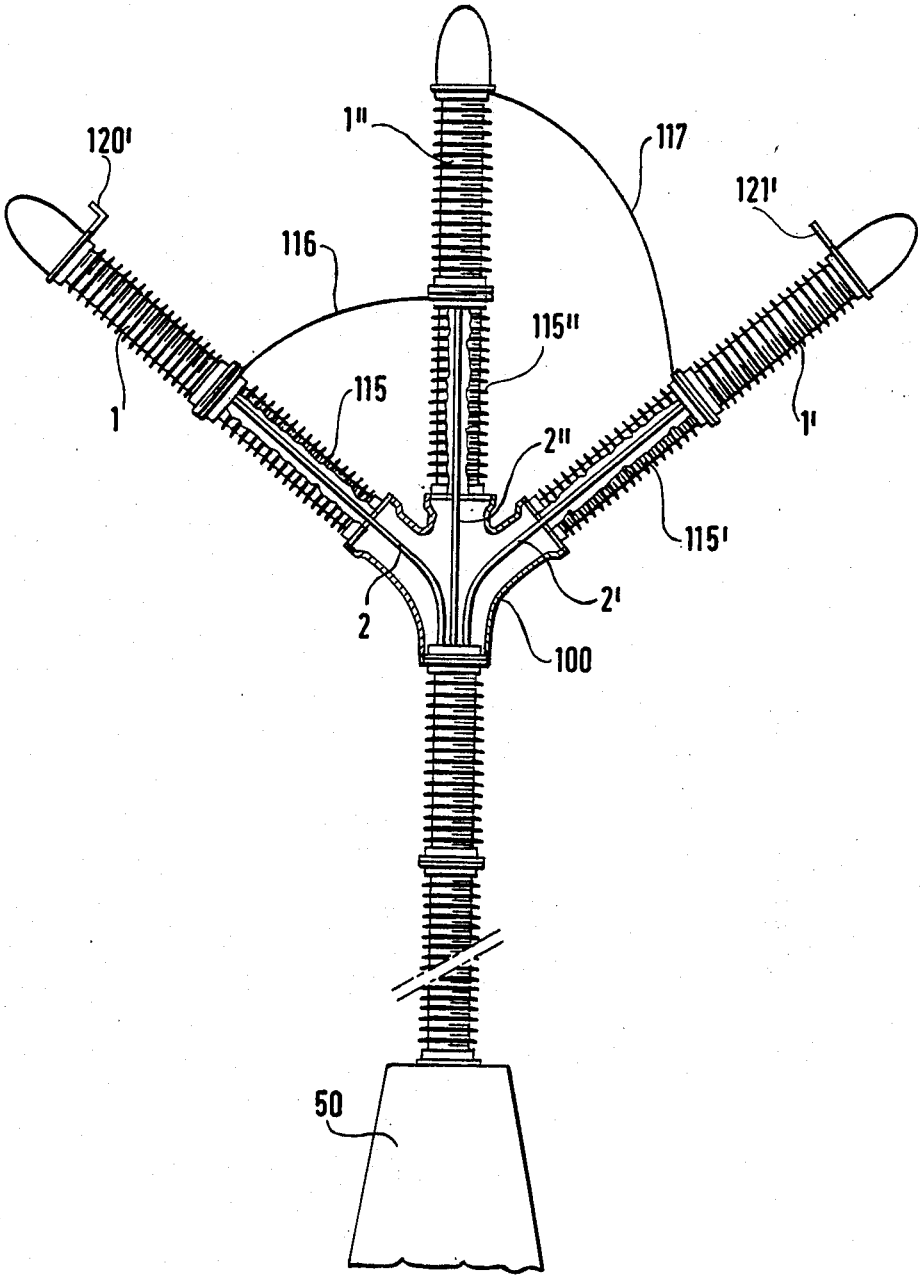

FIG. 8 shows a variant of the FIG. 7 circuit breaker.

All three chambers 1, 1' and 1'' are mounted on respective insulators 115, 115' and 115'' themselves mounted on the structure 100.

An electrical connection 116 is provided between the chamber 1 and the chamber 1'', and a second electrical connection 117 is provided between the chamber 1'' and the chamber 1'.

The chambers 1 and 1' are symmetrically disposed about the vertical chamber 1'' in a V-configuration with an angle of about 100°.

A current inlet 120' is provided on the chamber 1 and a current outlet 121' is provided on the chamber 1'.

Naturally the guide tubes 2, 2' and 2'' all pass through their respective insulators 115, 115' and 115'' to reach the respective chambers 1, 1' and 1''. The portions of the tubes 2, 2' and 2'' located inside the insulators 115, 115' and 115'' are made of insulating material, as are the control rods guided by said tubes.

The air-lock devices that enable the breaker chambers to be dismantled without loosing gas may either be located in the chambers 1, 1' and 1'', or else they may be located in the insulators 115, 115' and 115''.

FIGS. 9, 9A, 10, and 10A show a further embodiment of the invention in which the flexible portion of the control shaft where it slides in the curved portion of the guide tube is constituted by a roller-chain, and the guide tube is of rectangular or square cross section, such that the rollers bear against a pair of opposite inside faces of the guide tube.

Advantageously the roller axles are terminated in rounded ends that bear against the other pair of opposite inside faces of the guide tube.

This arrangement improves circuit breaker reliability at lower cost, and enables tighter curves to be used in the curved portions of the guide tubes.

Figures 9, 9A, 10, 10A:
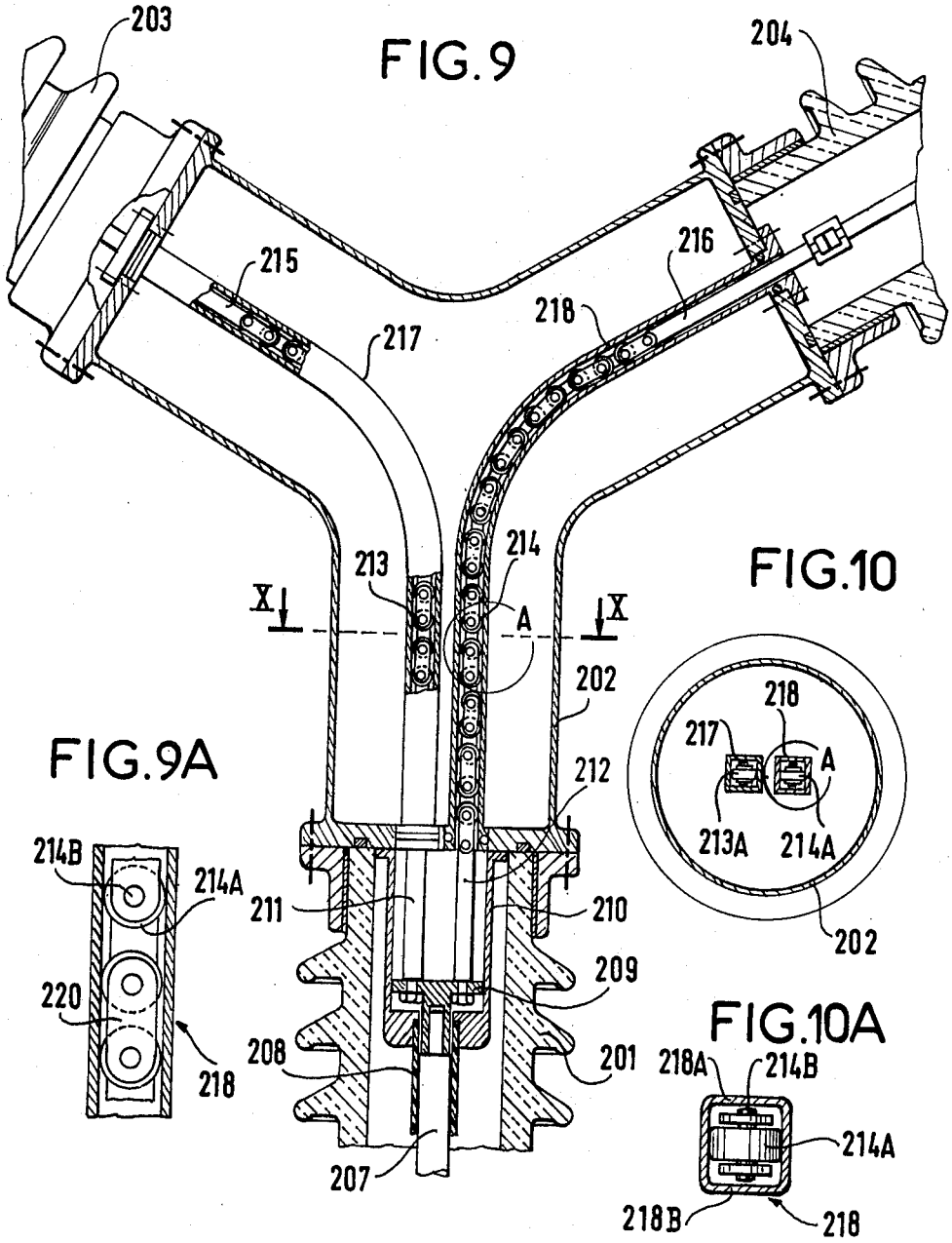
FIG. 9 is a view similar to FIG. 1A showing another embodiment of the invention.
FIG. 9A is a view on a larger scale of a portion A of FIG. 9.
FIG. 10 is a cross section along a line X—X in FIG. 9.
FIG. 10A is a view on a larger scale of a portion A of FIG. 10.

In FIG. 9, a ceramic support insulator 201 supports a hollow metal intermediate structure 202. Two breaker chambers 203 and 204 are supported by the ends of the structure 202, and each of the chambers 203 and 204 has fixed contacts connected to an external member, and moving internal contacts.

The moving contacts are moved by an insulating control shaft 207 associated with conventional drive means (not shown). The shaft 207 is guided inside the insulating support 201 by an insulating tube 208. The top of the shaft 207 slides a beam 209 inside a tube 210.

The beam 209 has two further shafts connected thereto to actuate the moving contacts in respective ones of the chambers 203 and 204. Each of said further shafts comprises a rigid portion 211 or 212 connected to the beam 209, a rigid portion 215 or 216 fixed to the moving contacts of the breaker chambers, and a flexible portion 213 or 214 disposed between said rigid portions. The flexible portions are constituted by roller-chains.

The shafts are guided in respective guide tubes 217 and 218 having a bent portion between two straight portions. The tubes are of rectangular or square cross section such that the rollers 213A and 214A of the chains roll on one or other of the faces of a first pair of opposite inside faces of the tube 217 or 218.

The rollers have axles which are interconnected in known manner by plate members 220 (FIG. 9A).

The ends 213B and 214B of the roller axles are rounded (preferably in the form of hemispheres) and may bear against one or other of the faces of the other pair of opposite inside faces of the guide tubes 217 and 218.

The guide tubes 217 and 218 are gas-tight and provide a path for an insulating gas under pressure to flow between the breaker chambers 203 and 204 and the inside of the insulating column 201. This roller-chain embodiment of the invention is equally applicable to a circuit breaker having three chambers connected in series such as shown in FIG. 8. There would then be three roller-chain shafts guided in three respective tubes, with all three shafts being connected to the same beam 209 under the control of a single rigid vertical shaft 207.

The above-described roller-chain embodiment of the invention has the advantages of being relatively cheap, of being highly efficient, of enabling the guide tubes to be more tightly curved, and of simplifying the control mechanism of the circuit breaker.

In particular, such an arrangement enables the breaker chambers to be placed at a wide angle, which may go as far as both chambers being horizontal in some cases. The guide tubes would then curve through 90°, and may be obtained either by bending a straight tube or by milling a curved trough-shaped component and applying a cover thereto. In the latter case, the assembled curved tube needs to be fitted inside a flexible jacket to provide gas-tight sealing.

A 90° angle may be used in switchgear located inside a metal housing which is entirely filled with insulating gas under pressure. In such a case the chambers 203 or 204 are not provided with individual insulating covers, but are completely surrounded by the insulating gas. The structure 202 together with the guide tubes serves to transmit motion to the breaker chambers. The insulator 201 would then be replaced by a conical feed-through of the kind conventionally used for switch gear when completely immersed in insulating gas.

We claim:

1. A pressurized gas circuit breaker comprising: a vertical insulating support; an intermediate structure mounted on said support and having at least two breaker chambers per phase, said chambers being disposed in a V-configuration on said intermediate structure, said support and said breaker chambers being filled with gas under pressure; said circuit breaker further comprising a control jack situated at the bottom of the support, and means for transmitting motion from the jack to the chambers to operate circuit breaking means located therein; the improvement wherein; said means for transmitting motion comprise: gas-tight guide tube means filled, in use, with gas under pressure and having a straight insulating portion situated inside the vertical insulating support and curved portions situated inside said intermediate structure and leading to respective ones of said breaker chambers; and control shaft means mounted with a sliding fit inside said guide tube means, said control shaft means having one end connected to said control jack, and other ends connected to respective ones of said breaker chambers, the portions of said control shaft means that slide in the curved guide tube portions being flexible; and wherein each breaker chamber is fitted with a respective sliding air-lock for sealing at one end the breaker chamber and at another end the guide tube means, said air-lock comprising two separable members one of which is made fast to the breaker chamber and the other of which is made fast to the guide tube means, and said control shaft means comprising coupling means located inside said air-lock to enable the control shaft means to be separated into a first portion connected to the breaker chamber and a second portion connected to the guide tube means.

2. A pressurized gas circuit breaker according to claim 1, wherein the flexible portions of the control shaft means comprise respective rods of smaller diameter than the inside diameter of the curved portions of the guide tube means, said rods being fitted with regularly spaced rings of outside diameter substantially equal to the inside diameter of said curved portions and being fitted therein and being suitable for allowing the gas under pressure to flow along said curved portions.

3. A pressurized gas circuit breaker according to claim 1, wherein said curved portions of the guide tube means are of smaller diameter than the straight portion thereof, the portion of the control shaft means that is slidably mounted in the curved portions of the guide tube means being of substantially the same diameter as said curved portions, and pipe means for effecting gas flow between the breaker chambers and the inside of the insulating support, and said pipe means being fitted with stop cocks.

4. A pressurized gas circuit breaker according to claim 1, comprising first and second breaker chambers in said V-configuration and a third breaker chamber mounted vertically above the intermediate structure on an insulator, said third breaker chamber being situated in the same plane as the first and second breaker chambers, said circuit breaker having a current inlet connected to the first breaker chamber, a current outlet connected to the third breaker chamber, and an external connection between the second breaker chamber and the third breaker chamber.

5. A pressurized gas circuit breaker according to claim 1, comprising first and second breaker chambers in said V-configuration and a third breaker chamber mounted vertically above the intermediate structure on an insulator, said third breaker chamber being situated in the same plane as the first and second breaker chambers, said circuit breaker having a current inlet connected to the first breaker chamber, a current outlet connected to the second breaker chamber, and external connections respectively between the first breaker chamber and the third breaker chamber and between the third breaker chamber and the second breaker chamber.

6. A circuit breaker according to claim 1, wherein the flexible portions of the control shaft means are constituted by roller-chains, and wherein the corresponding curved portions of the guide tube means are constituted by tubing of rectangular cross section having pairs of opposite inside faces, with the rollers of the roller-chains bearing against one said pair of opposite inside faces of said tubing.

7. A pressurized gas circuit breaker according to claim 7, wherein the rollers have axles terminating in rounded heads that bear against the other pair of opposite inside faces of said tubing.

* * * * *